US007253560B2

(12) United States Patent
Harada

(10) Patent No.: US 7,253,560 B2
(45) Date of Patent: Aug. 7, 2007

(54) TRIODE SURFACE DISCHARGE TYPE PLASMA DISPLAY PANEL

(75) Inventor: Hideki Harada, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 11/328,085

(22) Filed: Jan. 10, 2006

(65) Prior Publication Data

US 2006/0113915 A1 Jun. 1, 2006

Related U.S. Application Data

(62) Division of application No. 10/424,089, filed on Apr. 28, 2003, now Pat. No. 7,019,461.

(30) Foreign Application Priority Data

May 9, 2002 (JP) ..... 2002-133997

(51) Int. Cl.
*H01J 17/49* (2006.01)

(52) U.S. Cl. ..... 313/586; 313/582; 313/587; 445/24; 445/25

(58) Field of Classification Search ..... None
See application file for complete search history.

(56) References Cited

U.S. PATENT DOCUMENTS 4,423,356 A 12/1983 Sato et al. ..... 315/169.2
4,843,281 A 6/1989 Mendelsohn ..... 313/587
5,977,708 A 11/1999 Amatsu et al. ..... 313/586
6,160,345 A * 12/2000 Tanaka et al. ..... 313/489
6,184,621 B1 * 2/2001 Horiuchi et al. ..... 313/586
6,232,717 B1 5/2001 Oida et al. ..... 313/586
6,354,899 B1 3/2002 Moore ..... 445/25
6,600,265 B1 7/2003 Ebihara et al. ..... 313/586
2003/0020404 A1 * 1/2003 Su et al. ..... 313/582
2003/0038757 A1 * 2/2003 Kojima ..... 345/60

FOREIGN PATENT DOCUMENTS

JP 2001139345 A * 5/2001

* cited by examiner

*Primary Examiner*—Sikha Roy
(74) *Attorney, Agent, or Firm*—Staas & Halsey LLP

(57) ABSTRACT

An AC plasma display panel has a pair of panels disposed in spaced opposed relation, and each having a plurality of electrodes formed on an opposed surface thereof and mostly covered with a dielectric layer; and a sealing member which seals the periphery of the pair of panels. The electrodes each have a portion uncovered with the dielectric layer, and the sealing member is disposed in contact with the uncovered portions of the electrodes. With this arrangement, the discharge space can be kept gas-tightly sealed by the sealing member without communication with the outside of the display panel which may otherwise occur due to the presence of voids on opposite sides and surfaces of the electrodes.

8 Claims, 8 Drawing Sheets

TRIODE SURFACE DISCHARGE TYPE PLASMA DISPLAY PANEL

This application is a divisional of application Ser. No. 10/424,089, filed Apr. 28, 2003, now U.S. Pat. No. 7,019, 461 which is incorporated herein by reference.

CROSS-REFERENCE TO RELATED APPLICATION

This application is related to Japanese patent application No. 2002-133997 filed on May 9, 2002, whose priority is claimed under 35 USC § 119, the disclosure of which is incorporated by reference in its entirety.

BACKGROUND OF THE INVENTION

1. Field of the Invention

The present invention relates to a plasma display panel and, more particularly, to an AC plasma display panel having a sealing structure for isolating a discharge space from an external environment.

2. Description of the Related Art

A conventional AC plasma display panel will be described with reference to FIGS. 6 to 8. FIG. 6 is a partial perspective view illustrating a plasma display panel of triode surface discharge type known as a typical AC panel, and FIGS. 7(A) and 7(B) are a top view and a sectional view, respectively, illustrating major portions of a front panel of the plasma display panel. FIG. 8 is a sectional view illustrating major portions of the plasma display panel.

As shown, the conventional plasma display panel of triode surface discharge type includes a front panel 101 having pairs of main electrodes 111 for display discharge and a rear panel having address electrodes 121 for address discharge. A discharge gas of a xenon/neon gas mixture is filled in a discharge space defined between the front panel 101 and the rear panel 102. A sealing member 103 is provided between the front panel 101 and the rear panel 102 around a display region ES for sealing the discharge space from an external environment.

The main electrodes 111 in each pair are arranged in parallel adjacent relation on an inner surface of a glass substrate 112 of the front panel 101. One of the main electrodes 111 in each pair serves as a scan electrode for causing address discharge cooperatively with any of the address electrodes 121. The main electrodes 111 each include a transparent electrode 111*a* and a bus electrode 111*b*, and are covered with a dielectric layer 113 having a thickness of about 30 μm. A protective film 114 of MgO having a thickness of several thousands angstroms is provided on the surface of the dielectric layer 113.

The address electrodes 121 are arranged in intersecting relation to the main electrode pairs 111 on an inner surface of a glass substrate 122 of the rear panel 102, and covered with a dielectric layer 123 having a thickness of about 10 μm. Barrier ribs 124 each having a height of 150 μm are provided in a striped configuration between the address electrodes 121 on the dielectric layer 123, so that the barrier ribs 124 and the address electrodes 121 are arranged in alternating relation.

Next, an explanation will be given to how to produce the plasma display panel. For preparation of the front panel 101, the transparent electrodes 111*a* are first formed on the glass substrate 112 by a sputtering method. Then, Cr, Cu and Cr films are sequentially formed over the transparent electrodes 111*a* on the glass substrate 112, and a resist pattern is formed on the Cr, Cu and Cr films, which are in turn etched for formation of the bus electrodes 111*b* in association with the transparent electrodes 111*a*. Thus, the main electrode pairs 111 are formed. Then, $SiO_2$ is deposited on the glass substrate 112 formed with the main electrode pairs 111 by a gas-phase method such as a CVD method for formation of the dielectric layer 113. Finally, MgO is deposited on the dielectric layer 113 by a vacuum vapor deposition method for formation of the protective film 114.

After the rear panel 102 is prepared, the front panel 101 and the rear panel 102 are combined in the following manner. A sealing glass paste is applied on the dielectric layer 113 of the front panel 101 around the display region ES by a dispenser method (this state is shown in FIGS. 7(A) and 7(B) which illustrate the front panel 101 in plan and in section, respectively). Then, the front panel 101 and the rear panel 102 are combined in opposed relation, and heat-treated. In the heat treatment, the glass paste is baked for formation of the sealing glass member 103. Thus, the discharge space is sealed (see FIG. 8).

Although the formation of the dielectric layer 113 is achieved by depositing $SiO_2$ by the gas-phase method (e.g., the CVD method) in the aforesaid method, a ZnO-based frit glass is otherwise employed as a material for the dielectric layer 113*a*. In a prior art, a lead-containing frit glass (e.g., a PbO-based frit glass) is also used for the formation of the dielectric layer 113, but the lead-containing frit glass has recently become obsolete from the viewpoint of environmental issues and recycling.

When the bus electrodes 111*b* are formed in association with the transparent electrodes 111*a* by sequentially forming the Cr, Cu and Cr films over the transparent electrodes 111*a* on the glass substrate 112 of the front panel 101, forming a resist pattern on the Cr, Cu and Cr films, and etching the Cr, Cu and Cr films in the production of the conventional AC plasma display panel having the aforesaid construction, the bus electrodes 111*b* are liable to overhang. This makes it impossible to properly cover the bus electrodes 111*b* with the dielectric layer 113 formed by the gas-phase method (e.g., the CVD method). Hence, there is a possibility that voids are present on opposite sides of the bus electrodes 111*b*. If the front panel 101 is prepared by forming the protective film 114 on the dielectric layer 113 with the voids present on the opposite sides of the bus electrodes 111*b* and the plasma display panel is produced by combining the thus prepared front panel 101 and the rear plate 102, sealing the front panel 101 and the rear panel 102 by the sealing glass member 103 and filling the discharge gas in the discharge space, the discharge space is likely to communicate with the outside of the panel through the voids present on the opposite sides of the bus electrodes 111*b*. Therefore, the discharge space cannot be kept gas-tightly sealed. Further, where the dielectric layer 113 is formed of a PbO-free frit glass, the adhesion between the dielectric layer 113 and the bus electrodes 111*b* is poor. Therefore, voids are likely to be present between the dielectric layer 113 and the bus electrodes 111*b*.

SUMMARY OF THE INVENTION

To solve the aforesaid drawbacks, the present invention is directed to an AC plasma display panel having a discharge space kept gas-tightly sealed without suffering from the influence of voids present on the opposite sides and surfaces of electrodes.

In accordance with the present invention, there is provided an AC plasma display panel, which comprises: a pair of panels disposed in spaced opposed relation, and each having a plurality of electrodes formed on an opposed surface thereof and mostly covered with a dielectric layer; and a sealing member which seals the periphery of the pair of panels; wherein the electrodes each have a portion uncovered with the dielectric layer, and the sealing member is disposed in contact with the uncovered portions of the electrodes. In the present invention, the electrodes are each partly uncovered with the dielectric layer, and the sealing member directly contacts the uncovered portions of the electrodes. Therefore, no voids are present on the opposite sides and surfaces of the electrodes, so that a discharge space defined between the panels can be kept gas-tightly sealed by the sealing member without communication with the outside of the display panel which may otherwise occur due to the presence of voids on the opposite sides and surfaces of the electrodes. Thus, the plasma display panel can ensure proper display by stable electric discharge for a long period of time.

In the inventive plasma display panel, the dielectric layer has a cut-away portion formed in a peripheral region thereof, and the sealing member contacts the uncovered portions of the electrodes via the cut-away portion of the dielectric layer. In this case, the cut-away portion is not formed on the peripheral edge of the dielectric layer but in the peripheral region of the dielectric layer, and the sealing member directly contacts the uncovered portions of the electrodes. Therefore, the discharge space can be kept gas-tightly sealed by the sealing member, and portions of the dielectric layer located on longitudinally opposite ends of the electrodes can easily be etched.

In the inventive plasma display panel, the dielectric layer is composed of a lead-free frit glass. In this case, the electrodes are mostly covered with the dielectric layer of the lead-free frit glass, and the sealing member directly contacts the uncovered portions of the electrodes. Therefore, the discharge space can be kept gas-tightly sealed by the sealing member. Further, no lead-based pollutant is generated when the plasma display panel is scrapped.

In the inventive plasma display panel, the electrodes each comprise a plurality of thin electrode films. In this case, the electrodes each comprising the plurality of thin electrode films are provided on the panel and mostly covered with the dielectric layer, and the sealing member directly contacts the uncovered portions of the electrodes. Therefore, the discharge space can be kept gas-tightly sealed by the sealing member, even if voids are present between the electrodes and the dielectric layer.

BRIEF DESCRIPTION OF THE DRAWINGS

FIGS. 1(A) and 1(B) are a top view and a sectional view, respectively, illustrating major portions of a front panel of a plasma display panel according to a first embodiment of the present invention;

DETAILED DESCRIPTION OF THE INVENTION

First Embodiment

Figure 1A:
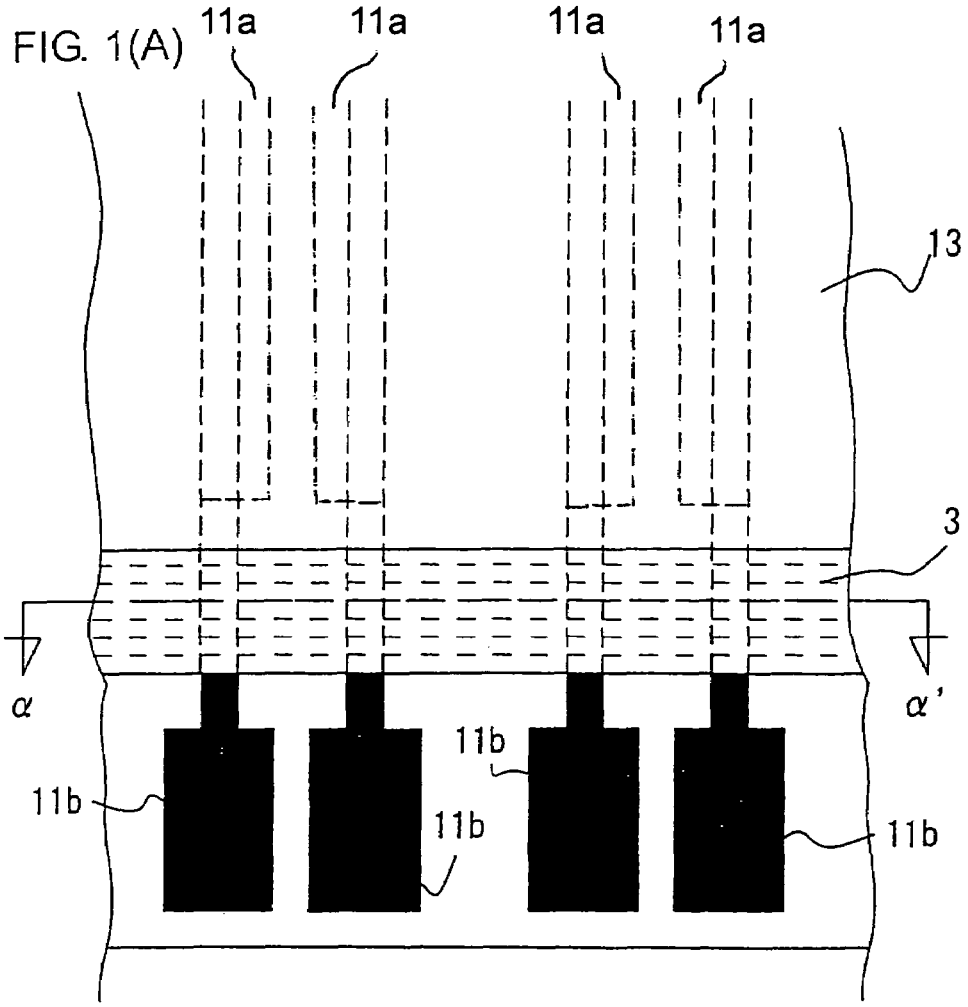
Figure 1A:
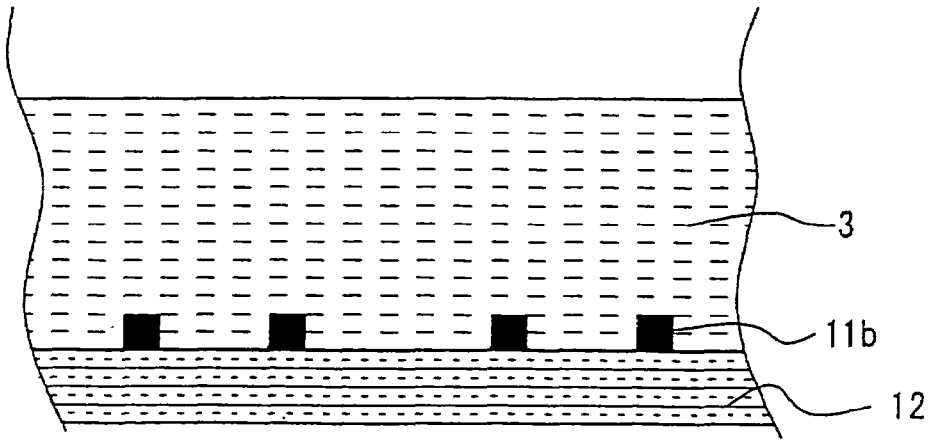
Figure 2:
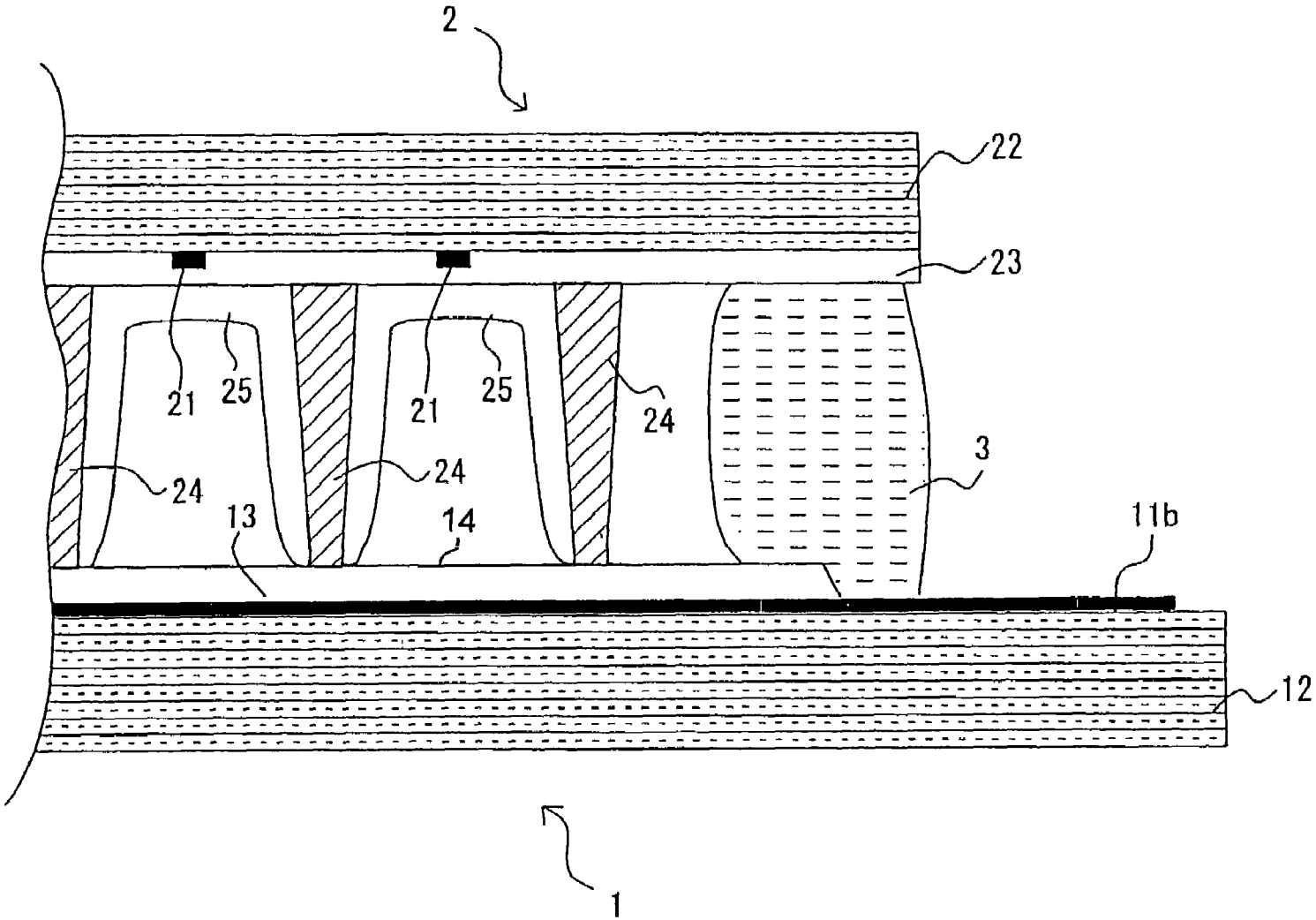
FIG. 2 is a sectional view illustrating major portions of the plasma display panel according to the first embodiment.

A plasma display panel according to a first embodiment of the present invention will hereinafter be described with reference to FIGS. 1(A), 1(B) and 2. FIGS. 1(A) and 1(B) are a top view and a sectional view, respectively, illustrating major portions of a front panel of the plasma display panel according to this embodiment, and FIG. 2 is a sectional view illustrating major portions of the plasma display panel according to this embodiment.

As shown, the plasma display panel according to this embodiment includes a front panel 1 having pairs of main electrodes 11 for display discharge, and a rear panel 2 having address electrodes 21 for address discharge, like the conventional plasma display panel. The front panel 1 and the rear panel 2 are disposed in spaced opposed relation, and a sealing glass member 3 is provided between the front panel 1 and the rear panel 2 in direct contact with the electrodes without intervention of a dielectric layer 13 to define a sealed discharge space.

The main electrodes 11 in each pair are arranged in parallel adjacent relation on an inner surface of a glass substrate 12 of the front panel 1. One of the main electrodes 11 in each pair serves as a scan electrode for causing address discharge cooperatively with any of the address electrodes 21. The main electrodes 11 each include a transparent electrode 11*a* and a bus electrode 11*b*, and are mostly covered with the dielectric layer 13, which has a thickness of about 30 μm. A protective film 14 of MgO having a thickness of several thousands angstroms is provided on the surface of the dielectric layer 13.

The address electrodes 21 are arranged in intersecting relation to the main electrode pairs 11 on an inner surface of a glass substrate 22 of the rear substrate 2, and covered with a dielectric layer 23 having a thickness of about 10 μm. Barrier ribs 24 each having a height of 150 μm are provided in a striped configuration between the address electrodes 21 on the dielectric layer 23, so that the barrier ribs 24 and the address electrodes 21 are arranged in alternating relation.

The sealing glass member 3 is disposed between the front panel 1 and the rear panel 2 around a display region ES, and kept in contact with the main electrodes 11 on the front panel 1. Even if air bubbles are present in the dielectric layer 13, the discharge space can be kept gas-tightly sealed.

Next, an explanation will be given to how to form the front panel 1, how to form the rear panel 2, and how to combine the front panel 1 and the rear panel 2 in the production of the plasma display panel according to this embodiment.

First, the transparent electrodes 11*a* are formed on the major surface of the glass substrate 12 of the front panel 1. The formation of the transparent electrodes 11*a* is achieved by forming a tin oxide film and an indium/tin oxide film on the entire glass substrate 12 by a sputtering method and patterning these films by a photolithography method.

Then, the bus electrodes 11*b* are formed on the glass substrate 12 formed with the transparent electrodes 11*a*. The formation of the bus electrodes 11*b* is achieved by forming Cr, Cu and Cr films over the glass substrate 12 by a sputtering method and patterning these films into a predetermined configuration by a photolithography method in substantially the same manner as the formation of the transparent electrodes 11*a*. The transparent electrodes 11*a* and the bus electrodes 11*b* formed on the glass substrate 12 constitute the main electrode pairs 11.

Then, the dielectric layer 13 is formed on the glass substrate 12 formed with the main electrode pairs 11 by a plasma CVD method. In the plasma CVD method, a predetermined substance is deposited on an object by generating a plasma. The dielectric layer 13 is not formed on the entire glass substrate 12 of the front panel 1, but formed as covering a portion of the glass substrate 12 excluding longitudinally opposite end portions of the bus electrodes 11*b* as shown in FIG. 1(A) for electrical connection between the bus electrodes and an external power source. Alternatively, the formation of the dielectric layer 13 may be achieved by once forming a dielectric film on the entire surface of the glass substrate, and etching off portions of the dielectric film overlying the longitudinally opposite end portions of the bus electrodes 11*b*. Then, the protective film 14 of MgO is formed on the dielectric layer 13 by a vacuum vapor deposition method. Thus, the front panel 1 is prepared.

Subsequently, the address electrodes 21 are formed on the glass substrate 22 of the rear panel 2 in substantially the same manner as in the preparation of the front panel 1. The formation of the address electrodes 21 is achieved by any of various methods hitherto proposed. Exemplary methods include a pattern printing method in which an electrode material (e.g., Ag) is deposited on a substrate by printing, a chemical etching method in which an electrode material is applied on the entire substrate, then baked and chemically etched, and a lift-off method in which a dry film photoresist is applied on the entire substrate and then patterned.

The dielectric layer 23 is formed on the glass substrate 22 formed with the address electrodes 21 in substantially the same manner as in the formation of the dielectric layer 13 on the front panel 1. Then, the barrier ribs 24 are formed on the dielectric layer 23 formed on the glass substrate 22. The formation of the barrier ribs 24 is achieved typically by applying a low-melting-point glass paste as a barrier rib material over the glass substrate 22, applying a dry film photoresist on the resulting glass paste layer, exposing and etching the dry film photoresist, and sand-blasting the glass paste layer into a predetermined rib pattern by removing portions of the glass paste layer exposed from openings of the photoresist. Alternatively, any other methods hitherto proposed may be employed for the formation of the barrier ribs 24. In turn, fluorescent layers 25 are formed between the barrier ribs 24 on the glass substrate 22. Thus, the rear panel 2 is prepared.

For combining the front panel 1 and the rear panel 2, a sealing glass paste is applied on the front panel 1 around the display region ES by a dispenser method as shown in FIGS. 1(A) and 1(B). Thus, the glass paste directly contacts portions of the bus electrodes 11*b* not covered with the dielectric layer 13. Thereafter, the front panel 1 and the rear panel 2 are combined in opposed relation, and then subjected to a heat treatment. By the heat treatment, the glass paste is baked for formation of the sealing glass member 3. Thus, the discharge space defined between the front and rear panels is sealed by the sealing glass member 3 (see FIG. 2).

After the front panel 1 and the rear panel 2 are combined, the discharge space defined between the front and rear panels is evacuated and then filled with a discharge gas such as a Ne/Xe gas mixture. Thus, the plasma display panel is produced.

In the plasma display panel according to this embodiment, the sealing glass member 3 covers the end portions of the bus electrodes 11*b* where voids are otherwise likely to occur on the opposite sides and surfaces of the bus electrodes 11*b*. Therefore, the discharge space can be kept gas-tightly sealed without communication with the outside of the plasma display panel which may otherwise occur due to the presence of the voids on the opposite sides and surfaces of the bus electrodes 11*b*. Thus, the plasma display panel can ensure stable electric discharge for display for a long period of time.

Second Embodiment

Figure 3A:
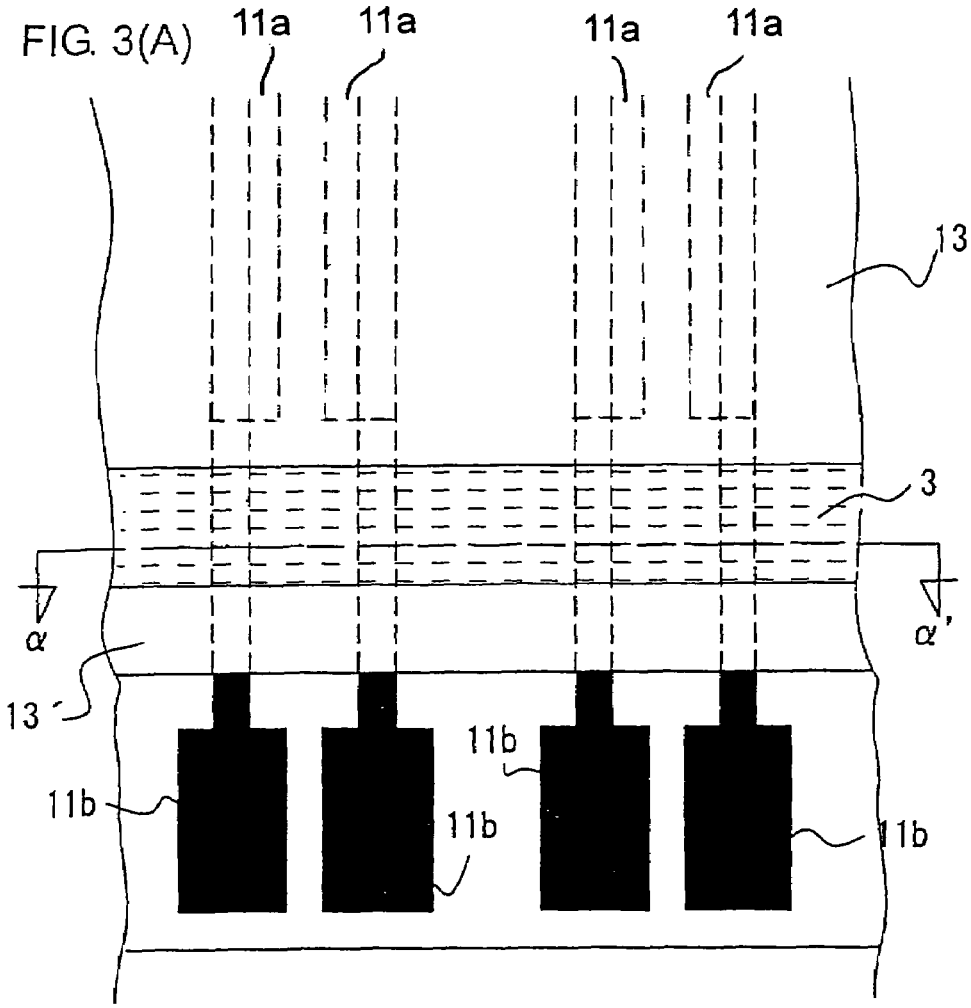
FIGS. 3(A) and 3(B) are a top view and a sectional view, respectively, illustrating major portions of a front panel of a plasma display panel according to a second embodiment of the present invention.
Figure 3B:
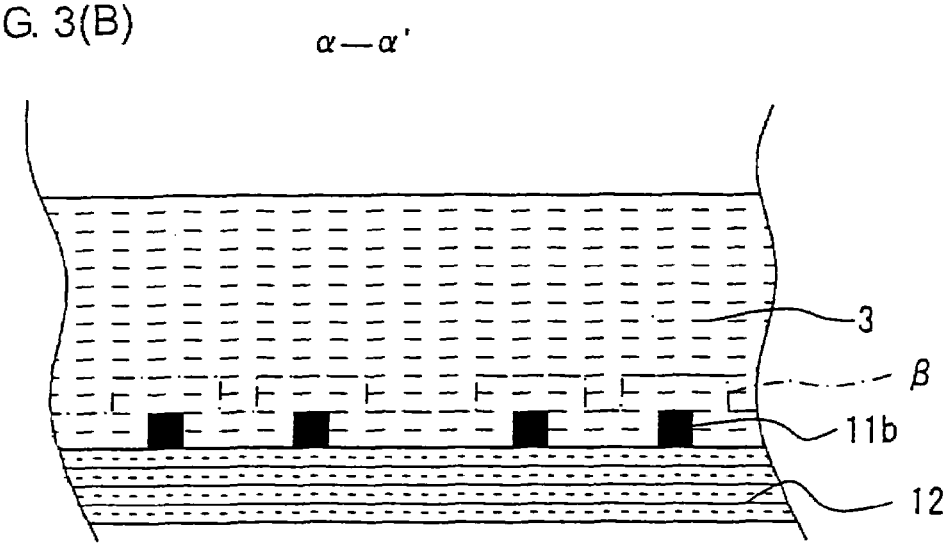
Figure 4:
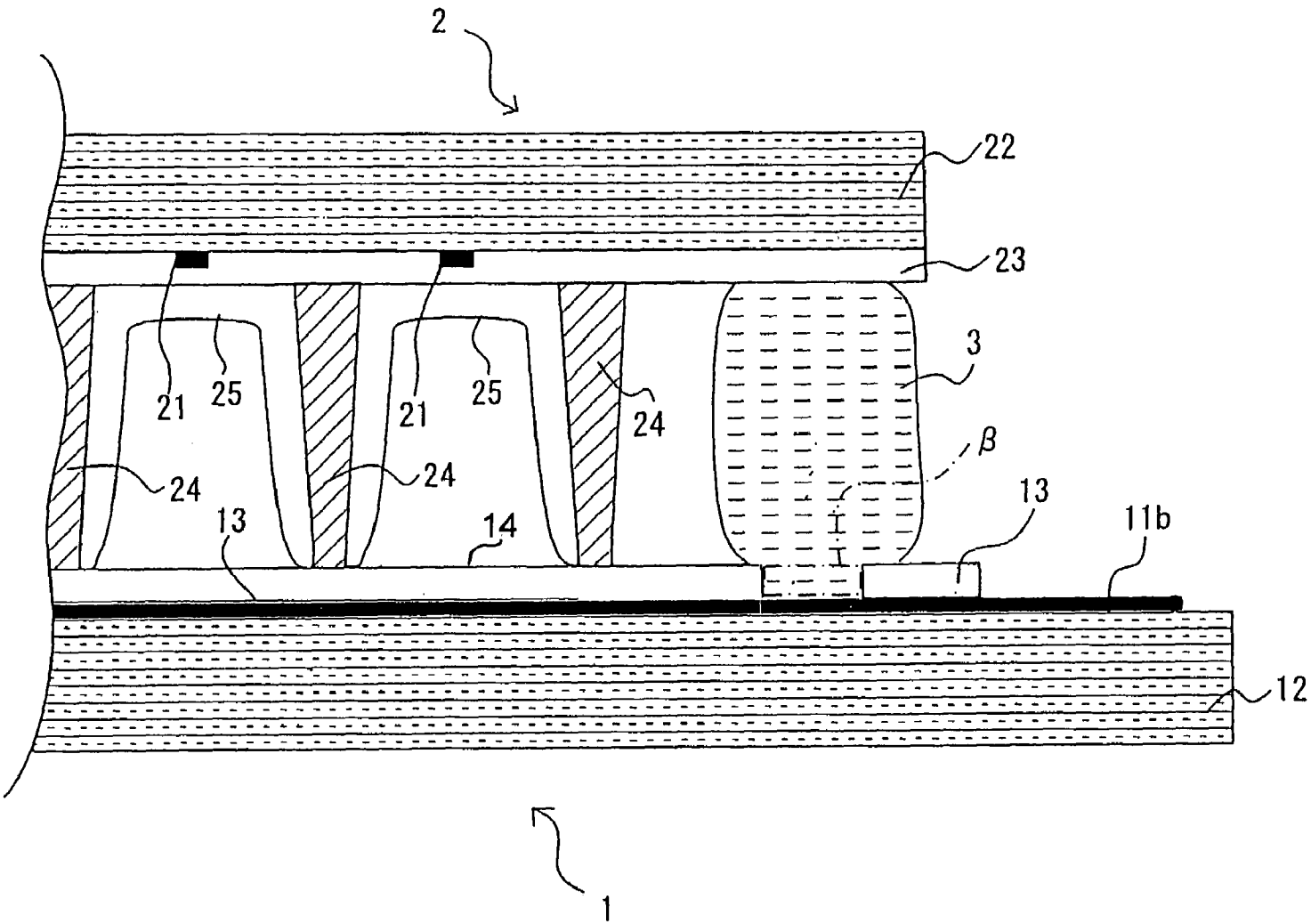
FIG. 4 is a sectional view illustrating major portions of the plasma display panel according to the second embodiment.

Although the plasma display panel according to the first embodiment is constructed such that the opposite end portions of the bus electrodes 11*b* are not covered with the dielectric layer 13 and the sealing glass member 3 is provided in direct contact with the opposite end portions of the bus electrodes 11*b*, a plasma display panel according to a second embodiment of the present invention is constructed such that apertures are formed in the dielectric layer 13 to partly expose the opposite end portions of the bus electrodes 11*b* and the sealing glass member 3 is provided as filling the apertures as shown in FIGS. 3(B) and 4. Thus, the sealing glass member 3 is disposed on the opposite end portions of the bus electrodes 11*b*, and portions 13' of the dielectric layer 13 are still present on the opposite end portions of the bus electrodes 11*b*. Therefore, the discharge space can be kept gas-tightly sealed by the sealing glass member 3, and the dielectric layer portions 13' disposed on the opposite end portions of the bus electrodes 11*b* can easily be etched.

Figure 5:
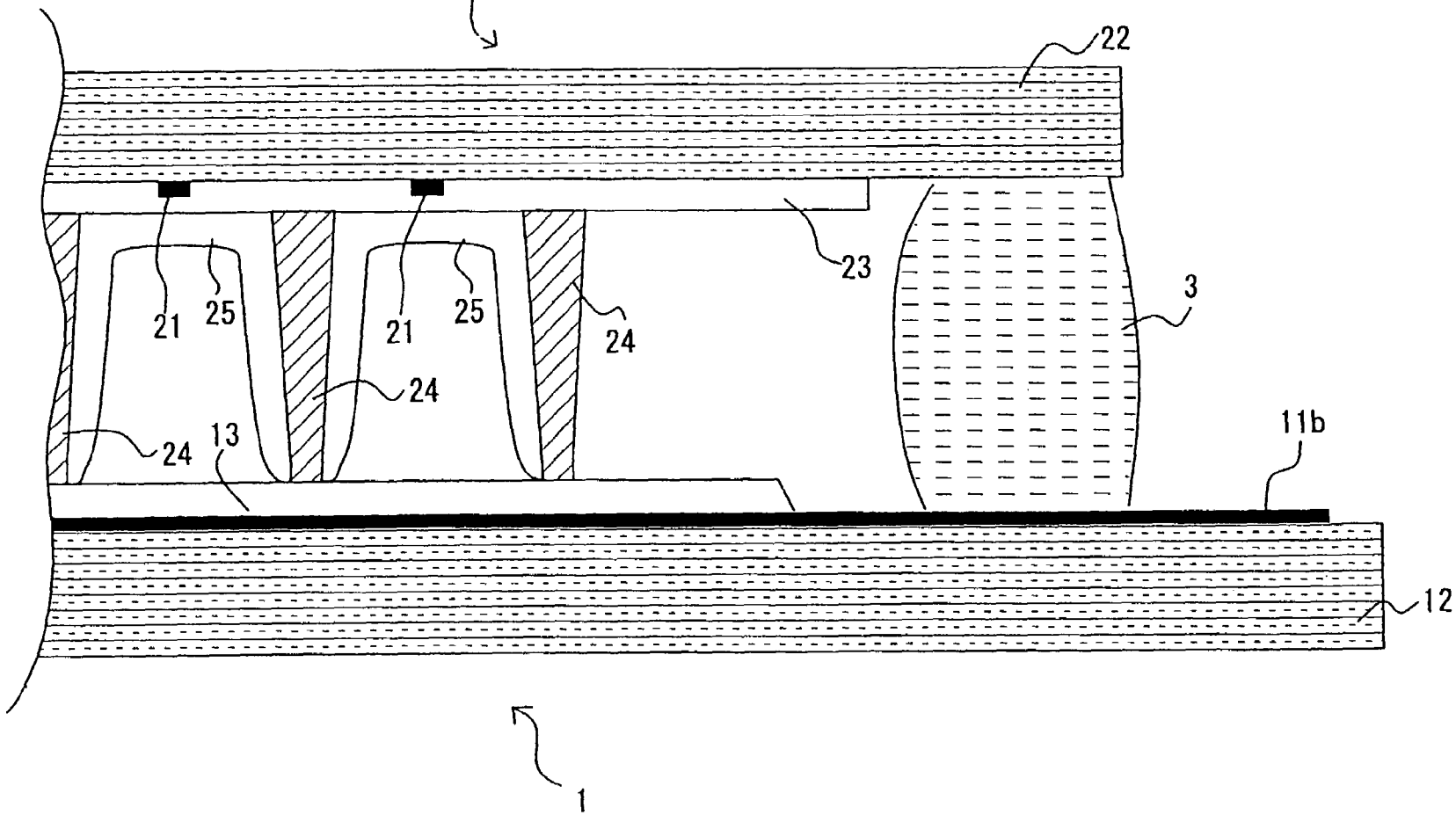
FIG. 5 is a sectional view illustrating major portions of a plasma display panel according to a modification of the first embodiment.
Figure 6:
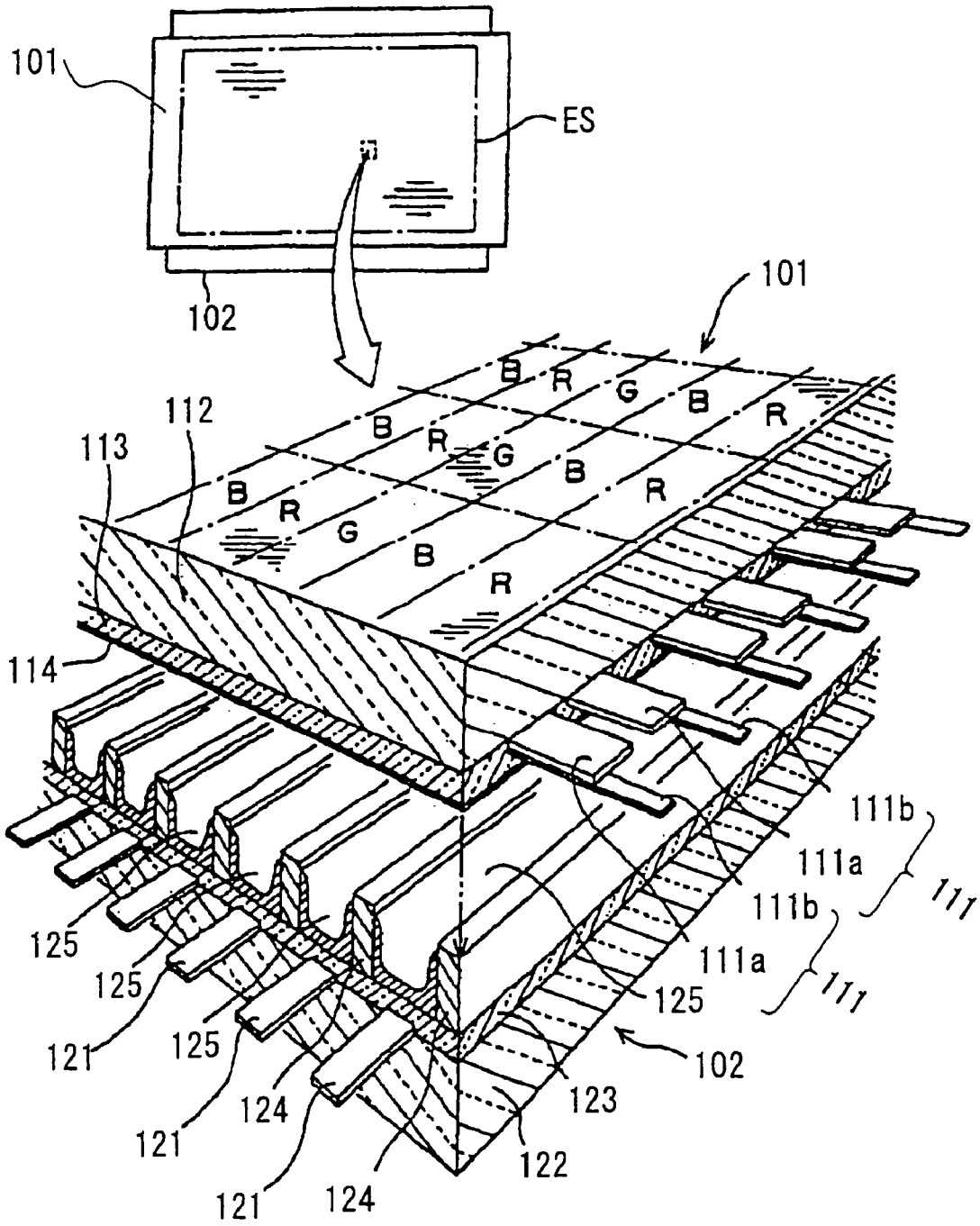
FIG. 6 (PRIOR ART)
FIG. 6 is a partial perspective view illustrating a plasma display panel of triode surface discharge type known as a typical AC panel.
Figure 7A:
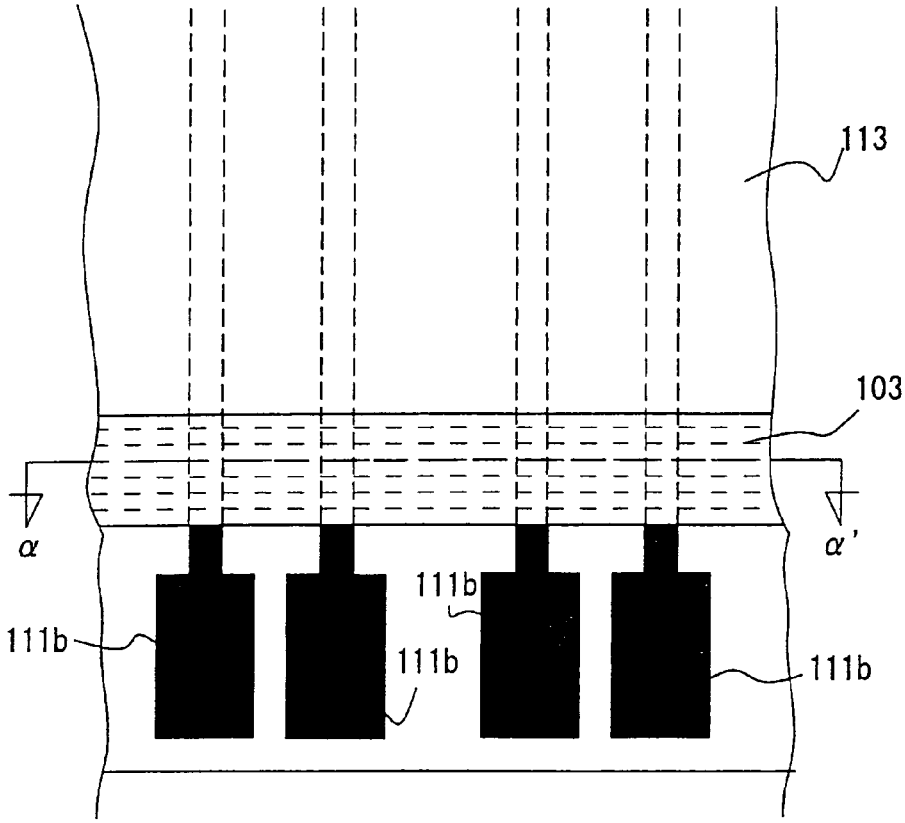
FIG. 7(A) (PRIOR ART)
FIGS. 7(A) and 7(B) are a top view and a sectional view, respectively, illustrating major portions of a front panel of the plasma display panel shown in FIG. 6.
Figure 7B:
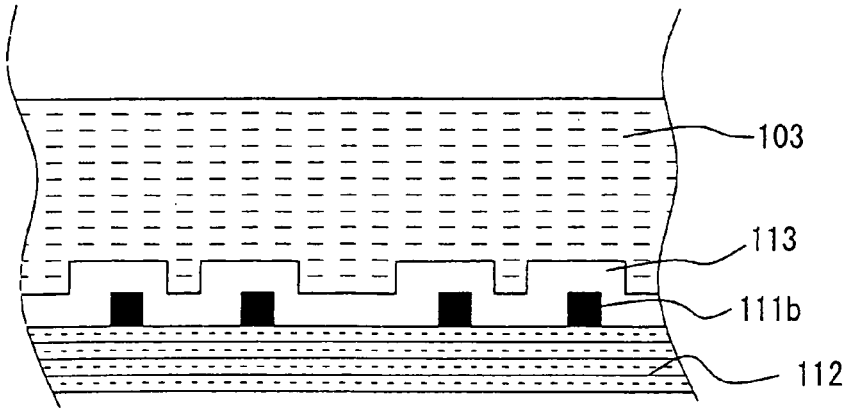
FIG. 7(B) (PRIOR ART)

In accordance with a modification of the first embodiment, as shown in FIG. 5, the sealing glass member 3 may be spaced apart from the dielectric layer 13, while directly contacting the bus electrodes 11*b*.

In the plasma display panel according to the first embodiment, the sealing glass member 3 is disposed in direct contact with the bus electrodes 11*b*. Similarly, the sealing glass member 3 may directly contact the address electrodes 21 without intervention of the dielectric layer 23.

EXAMPLE 1

Cr, Cu and Cr films were formed on a front panel 1 by the sputtering method, and patterned for formation of bus electrodes 11*b*. Then, $SiO_2$ was deposited to a thickness of 5.0 μm over the bus electrodes 11*b* under the following conditions by the plasma CVD method by means of a plasma CVD device of parallel plate type to form a dielectric layer 13 in a region as shown in FIG. 2. Subsequently, MgO was deposited to a thickness of 1.0 μm on the dielectric layer 13 by the vapor deposition method to form a protective film 14.

Introduced gas and flow rate: $SiH_4$/900 sccm
Introduced gas and flow rate: $N_2O$/9000 sccm
Radio frequency output: 2.0 kW
Substrate temperature: 400° C.
Vacuum degree: 3.0 Torr Then, a glass paste having a softening point of 430° C. was applied in a region of a sealing glass member 3 as shown in FIG. 2 by the dispenser method, and baked at 500° C. The front panel 1 and a rear panel 2 were baked at 450° C. to be combined in opposed relation. Then, a discharge space defined between the front panel and the rear panel was evacuated, and a Ne/Xe gas mixture was filled in the discharge space. Thus, a plasma display panel was produced.

A high-temperature high-humidity test was performed on the plasma display panel at 120° C. at 2 atm at 100% RH for 12 hours, while the electric discharge characteristics of the plasma display panel were evaluated. As a result, no variation was observed in the electric discharge characteristics.

EXAMPLE 2

After bus electrodes 11*b* were formed on a front panel 1 in the same manner as in Example 1, a $ZnO—B_2O_3—Bi_2O_3$ hybrid frit glass was deposited to a thickness of 30 μm over the but electrodes 11*b* to form a dielectric layer 13 in a region as shown in FIG. 2. Then, MgO was deposited to a thickness of 1.0 μm on the dielectric layer 13 by the vapor deposition method to form a protective film 14.

Then, a glass paste having a softening point of 430° C. was applied in a region of a sealing glass member 3 as shown in FIG. 2 by the dispenser method, and baked at 500° C. The front panel 1 and a rear panel 2 were baked at 450° C. to be combined in opposed relation. Then, a discharge space defined between the front panel and the rear panel was evacuated, and a Ne/Xe gas mixture was filled in the discharge space. Thus, a plasma display panel was produced.

A high-temperature high-humidity test was performed on the plasma display panel at 120° C. at 2 atm at 100% RH for 12 hours, while the electric discharge characteristics of the plasma display panel were evaluated. As a result, no variation was observed in the electric discharge characteristics.

EXAMPLE 3

An Ag paste was applied on a front panel 1 for formation of bus electrodes 10*b*, and then $SiO_2$ was deposited to a thickness of 5.0 μm over the bus electrodes 11*b* under the following conditions by means of a plasma CVD device of parallel plate type to form a dielectric layer 13 in a region as shown in FIG. 2. Subsequently, MgO was deposited to a thickness of 1.0 μm on the dielectric layer 13 by the vapor deposition method to form a protective film 14.

Introduced gas and flow rate: $SiH_4$/900 sccm
Introduced gas and flow rate: $N_2O$/9000 sccm
Radio frequency output: 2.0 kW
Substrate temperature: 400° C.
Vacuum degree: 3.0 Torr Then, a glass paste having a softening point of 430° C. was applied in a region of a sealing glass member 3 as shown in FIG. 2 by the dispenser method, and baked at 500° C. The front panel 1 and a rear panel 2 were baked at 450° C. to be combined in opposed relation. Then, a discharge space defined between the front panel and the rear panel was evacuated, and a Ne/Xe gas mixture was filled in the discharge space. Thus, a plasma display panel was produced.

A high-temperature high-humidity test was performed on the plasma display panel at 120° C. at 2 atm at 100% RH for 12 hours, while the electric discharge characteristics of the plasma display panel were evaluated. As a result, no variation was observed in the electric discharge characteristics.

COMPARATIVE EXAMPLE

Figure 8:
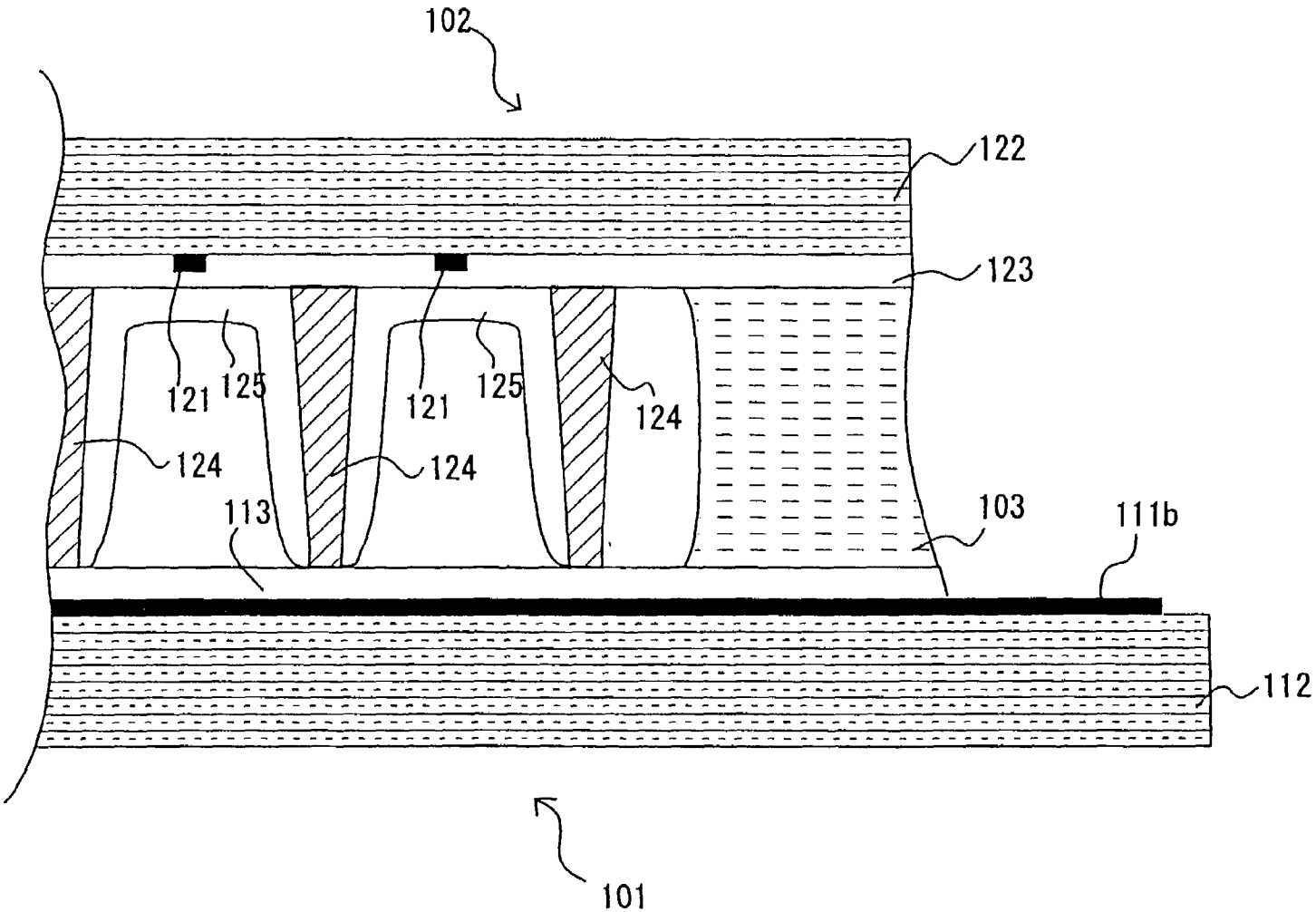
FIG. 8 (PRIOR ART)
FIG. 8 is a sectional view illustrating major portions of the plasma display panel shown in FIG. 6.

After bus electrodes 11*b* were formed on a front panel 1 in the same manner as in Example 1, $SiO_2$ was deposited to a thickness of 5.0 μm over the bus electrodes 11*b* under the following conditions by means of a plasma CVD device of parallel plate type to form a dielectric layer 13 in a region as shown in FIG. 8. Subsequently, MgO was deposited to a thickness of 1.0 μm on the dielectric layer 13 by the vapor deposition method to form a protective film 14.

Introduced gas and flow rate: $SiH_4$/900 sccm
Introduced gas and flow rate: $N_2O$/9000 sccm
Radio frequency output: 2.0 kW
Substrate temperature: 400° C.
Vacuum degree: 3.0 Torr Then, a glass paste having a softening point of 430° C. was applied in a region of a sealing glass member 3 as shown in FIG. 8 by the dispenser method, and baked at 500° C. The front panel 1 and a rear panel 2 were baked at 450° C. to be combined in opposed relation. Then, a discharge space defined between the front panel and the rear panel was evacuated, and a Ne/Xe gas mixture was filled in the discharge space. Thus, a plasma display panel was produced.

A high-temperature high-humidity test was performed on the plasma display panel at 120° C. at 2 atm at 100% RH for 12 hours, while the electric discharge characteristics of the plasma display panel were evaluated. As a result, a discharge voltage was increased and some pixels were unlit in edge portions of the plasma display panel.

In the present invention, as described above, the electrodes are each partly uncovered with the dielectric layer, and the sealing member directly contacts the uncovered portions of the electrodes. Therefore, no voids are present on the opposite sides and surfaces of the electrodes, so that the discharge space can be kept gas-tightly sealed by the sealing member without communication with the outside of the display panel which may otherwise occur due to the presence of voids on the opposite sides and surfaces of the electrodes. Thus, the plasma display panel can ensure proper display by stable electric discharge for a long period of time.

In the present invention, the cut-away portion is not formed on the peripheral edge of the dielectric layer but in the peripheral region of the dielectric layer, and the sealing member directly contacts the uncovered portions of the electrodes. Therefore, the discharge space can be kept gas-tightly sealed by the sealing member, and portions of the dielectric layer located on longitudinally opposite ends of the electrodes can easily be etched.

In the present invention, the electrodes are mostly covered with the dielectric layer of the lead-free frit glass, and the sealing member directly contacts the uncovered portions of the electrodes. Therefore, the discharge space can be kept gas-tightly sealed by the sealing member. Further, no lead-based pollutant is generated when the plasma display panel is scrapped.

In the present invention, the electrodes each comprising the plurality of thin electrode films are provided on the panel and mostly covered with the dielectric layer, and the sealing member directly contacts the uncovered portions of the electrodes. Therefore, the discharge space can be kept gas-tightly sealed by the sealing member, even if voids are present between the electrodes and the dielectric layer.

What is claimed is:

1. A triode surface discharge type AC plasma display panel comprising:

a pair of substrates disposed in spaced opposed relation, at least one of the pair of substrates of which has a plurality of display electrodes formed thereon and extended in a first direction, the plurality of display electrodes being mostly covered with a dielectric layer made of silicon dioxide ($SiO_2$); and a sealing member which seals the pair of substrates outside a display region, wherein the plurality of display electrodes have ends of bus electrodes laying outside the display region at an opposite end portions of the first direction on said at least one substrate and uncovered with the dielectric layer, the sealing member at the opposite end portions of the first direction of said at least one substrate is partially located on the dielectric layer and is disposed in contact with the uncovered ends of the bus electrodes, and further the sealing member at an another opposite end portions of a second direction intersecting the first direction of said at least one substrate is wholly located on the dielectric layer.

2. A plasma display panel as set forth in claim 1, wherein the dielectric layer is a CVD film is formed of silicon dioxide ($SiO_2$).

3. A plasma display panel as set forth in claim 1, wherein the display electrodes, comprising the bus electrodes, extending to the outside, the bus electrodes having a three-layer structure of Cr-Cu-Cr.

4. A plasma display panel as set forth in claim 2, wherein the display electrodes, comprising the bus electrodes, extending to the outside, the bus electrodes having a three-layer structure of Cr-Cu-Cr.

5. A plasma display panel as set forth in claim 1, wherein the display electrodes, comprising the bus electrodes, extending to the outside, the bus electrodes being formed of Ag paste.

6. A plasma display panel as set forth in claim 2, wherein the display electrodes, comprising the bus electrodes, extending to the outside, the bus electrodes being formed of Ag paste.

7. A triode surface discharge type AC plasma display panel comprising:

a pair of substrates disposed in spaced opposed relation, at least one of the pair of substrates of which has a plurality of display electrodes formed thereon and extended in a first direction, the plurality of display electrodes being mostly covered with a dielectric layer made of $ZnO—B_2O_3—Bi_2O_3$-based lead-free frit glass; and a sealing member which seals the pair of substrates outside a display region, wherein the plurality of display electrodes have ends of bus electrodes laying outside the display region at an opposite end portions of the first direction on said at least one substrate and uncovered with the dielectric layer, the sealing member at the opposite end portions of the first direction of said at least one substrate is partially located on the dielectric layer and is disposed in contact with the uncovered ends of the bus electrodes, and further the sealing member at an another opposite end portions of a second direction intersecting the first direction of said at least one substrate is wholly located on the dielectric layer.

8. A plasma display panel of AC surface discharge type, comprising:

a front panel on which a plurality of display electrodes are arranged in pairs and extended in a first direction;

a rear panel on which a plurality of address electrodes are arranged in a second direction intersecting relation to the first direction; and a sealing member which seals a periphery of the front and rear panels, the sealing member being formed of a low-melting point glass, wherein each of the display electrodes and the address electrodes has an end extending to the outside of a display area of the plasma display panel under the sealing member, the display electrodes on the front panel are covered with a dielectric layer formed of a CVD film of silicon dioxide, and the sealing member at an opposite end portions of the first direction of the front substrate is partially located on the dielectric layer and is disposed in contact with an uncovered end of one of the display electrodes, and further the sealing member at an another opposite end portions of a second direction intersecting the first direction of the front substrate is located on the dielectric layer.

* * * * *